US005120063A

United States Patent [19]

Birchler et al.

[11] Patent Number: 5,120,063

[45] Date of Patent: Jun. 9, 1992

[54] HEATER REGISTER GOLF CUP

[76] Inventors: Terry M. Birchler, 7614 Exploration Dr., Worthington, Ohio 43085; Brian A. Patten, 22146 Placeritos Blvd., Newhall, Calif. 91321

[21] Appl. No.: 461,021

[22] Filed: Jan. 4, 1990

[51] Int. Cl.[5] ..... A63B 57/00

[52] U.S. Cl. ..... 273/178 R; 273/34 A

[58] Field of Search ..... 98/101, 105, 109; 273/34 R, 34 A, 34 B, 178 R, 178 A, 178 B

[56] References Cited

U.S. PATENT DOCUMENTS

| | | | |
|---|---|---|---|
| 815,649 | 3/1906 | Smith | 273/178 |
| 1,513,917 | 11/1924 | Long | 273/178 |
| 1,538,822 | 5/1925 | Kennedy | 273/34 A |
| 1,581,092 | 4/1926 | Brooks | 273/178 |
| 2,031,525 | 2/1936 | Clarke | 273/36 |
| 2,453,605 | 11/1948 | Thomas | 273/35 |
| 2,716,029 | 8/1955 | Montgomery | 273/178 |
| 2,933,318 | 4/1960 | Boynton | 273/178 |
| 3,070,372 | 12/1962 | Brinati et al. | 273/178 |
| 3,341,207 | 9/1967 | Shusda | 273/178 |
| 3,451,682 | 6/1969 | Trimble | 273/176 |
| 3,558,139 | 1/1971 | Brandell | 273/176 |
| 3,610,631 | 10/1971 | Mulherin | 273/178 R |
| 3,643,944 | 2/1972 | Boyes | 273/34 R |
| 4,275,886 | 6/1981 | Bannon | 273/178 R |
| 4,338,859 | 7/1982 | Claytor | 98/105 |
| 4,396,194 | 8/1983 | Seiferth | 273/178 A |
| 4,429,882 | 2/1984 | Stanton | 273/177 R |
| 4,743,027 | 5/1988 | Simjian | 273/178 R |

*Primary Examiner*—Edward M. Coven
*Assistant Examiner*—William E. Stoll
*Attorney, Agent, or Firm*—Watkins, Dunbar & Pollick

[57] ABSTRACT

A practice golf putting cup is disclosed that eliminates the inclined ramps and ball trapping leaves found in the prior art by taking advantage of in-floor air ducts found in many homes. The invention consists of a cover for the air duct passage and has an opening in it blow which is attached a ball receiving cup that extends into the air duct. A ball retrieval basket with an attached flag pole is placed in the collecting cup and is used to retrieve putted balls. Aligning air holes in the receiving cup and retrieval basket permit the passage of air into or out of the air duct. By rotating the retrieval basket in the receiving cup, the amount of alignment of the air holes can be changed so as to control the amount of air flow.

15 Claims, 2 Drawing Sheets

HEATER REGISTER GOLF CUP

FIELD OF THE INVENTION

This invention relates to the general field of sports equipment. More particularly, it relates to a practice putting cup for the game of golf.

DESCRIPTION OF THE PRIOR ART

A wide variety of practice putting devices are described in the prior art. As representative examples of this art, U.S. Pat. No. 4,743,027 to Simjian discloses a golf putting device in which lifting rods are used to distort a typically plane surface. U.S. Pat. No. 4,429,882 to Stanton reveals a putting target having the same dimensions as a real hole in the green of a golf course with upward and downward sloping ramps. U.S. Pat. No. 4,396,194 to Seiferth shows a putting disk in which "leaves" are used to prevent the golf ball from rolling out of the center of the putting cup. U.S. Pat. No. 4,275,886 to Bannon describes a putting target located on an elevated surface with a ramp to the target. U.S. Pat. No. 3,558,139 to Brandell et al. details a putting device having a runner with a carton that contains a ball-receiving opening in an inclined bottom panel (FIG. 4). U.S. Pat. No. 3,451,682 to Trimble discloses a putting cup in which the cup is placed on its side to receive a golf ball which tilts the cup into an upright position.

U.S. Pat. No. 3,341,207 to Shusda reveals a ramp-type golf cup having a rocking platform to discharge balls "sunk" in the cup so that a number of balls can be played. U.S. Pat. No. 3,070,372 to Brinati et al. shows a putting practice device containing various raised and depressed areas, each of the depressed areas leading to the elevated ball-receiving opening. U.S. Pat. No. 2,933,318 to Boynton describes an elevated golf cup which uses ball bearings to simulate the rimming action of an actual cup on golf course. U.S. Pat. No. 2,716,029 to Montgomery details a putting device having a ramp with a hole near the raised end of the putting device. U.S. Pat. No. 2,453,605 to Thomas discloses a ramp-type putting apparatus having corded weights on each side of the apparatus to catch misdirected golf balls. U.S. Pat. No. 2,031,525 to Clarke shows a ramp-type hexagonal-shaped cardboard golf practice hole. U.S. Pat. No. 1,581,092 to Brooks describes a putting device having inclined runways over a putted ball travels before dropping into the center hole. U.S. Pat. No. 1,513,917 to Long illustrates a golf putting apparatus made up of rolling plates which are attached to tabs to prevent the golf ball from rolling out of the putting apparatus. U.S. Pat. No. 815,649 to Smith reveals an inclined-plane putting mat made out of a flexible material such as felt or rubber.

All of the prior art putting devices either have a ramp, e.g., U.S. Pat. No. 4,743,027 (12 in FIG. 1), or "leaves", e.g., U.S. Pat. No. 4,396,194 (116 in FIG. 5), that must be negotiated prior to the ball entering into the cup target. Such obstacles tend to distort the path or speed of the ball or both thereby preventing the golfer from getting a true simulation of the path and speed of the ball as it enters the golf cup.

SUMMARY OF THE INVENTION

The present inventors have solved this problem with the present invention which provides a practice golf cup that obviates the need for ramps and "leaves" found in the prior art. The invention utilizes an opening or floor passage found in the floor of many homes, i.e., a heating and cooling duct. By removing the grate or register from such a floor passage and substituting therefor the device of this invention, a practice putting device is realized that simulates actual playing conditions in so much as the cup opening is level with the putting surface.

The practice putting device of this invention consists of a level covering means such as a flat, planar cup-suspension member of a width and length equal to that of the grate or register that it replaces. That is, the edges of the cup suspension member extend beyond the edges of the floor passage so as to rest on the surrounding floor. In a preferred embodiment, the edges of the cup suspension member are of such size and thickness so as to produce a level surface in going from the carpet to the upper or top side of the cup suspension member when the cup suspension member is placed in the carpet depression formed by a removed grate or register. The cup suspension member has a circular opening through it, preferably of a size equal to a real hole in a golf course.

A ball collecting means such as a target, ball-receiving cup is attached to the covering means beneath the circular opening and extends downward into the floor passage. In effect and in a simple form, the receiving cup can consist of a cylindrical side wall attached at its upper or top edge to an underside edge of the cup suspension member that defines the circular opening in the cup suspension member. The lower or bottom edge of the cylindrical side wall is attached to the outer edge of a circular base or cup bottom. This target cup, which is beneath the circular opening, can be any shape so long as it provides a cavity which catches the ball thereby preventing it from traveling into the air duct.

Generally floor passages such as heating ducts are of several standard sizes. In order to facilitate the installation of the golf practice putting device into the air duct, indentations are provided on the underside of the planar cup suspension member to enable the removal of excess portions of the suspension member. Typically this is done by merely bending the excess portion so as to break it away from the remaining portion along the indentation. However, it is not necessary that indentations be used to install the cup suspension member. Other methods of obtaining the right size are possible such as cutting or scoring and breaking.

In order to strengthen and make the planar cup suspension member more rigid, one or more ribs can be added to the underside of the planar cup suspension member. Preferably, these support ribs are molded as one piece with the planar cup suspension member. A wide variety of designs can be used for the support ribs provided that the support ribs are restricted to such an underside area of the planar cup suspension member that they are capable of projecting downward into the floor passage.

In order to obtain a level surface with the adjacent floor covering material, it is desirable to add a mat on the top side of said planar cup suspension member. The mat covers all portions of the upperside of the planar cup suspension member with the exception of the opening in that member. The mat may be made of any suitable material including floor covering type materials or resilient materials such as a patterned rubber backing that is found on ping pong paddles. Preferably the mat is glued to the planar cup suspension member with a suitable adhesive.

In certain applications, it may be possible to cover the planar cup suspension member and the surrounding floor with the same mat. Thus for example, on a floor without a floor covering, it is possible to install the golf practice putting device into the floor passage and then cover the putting device and the surrounding floor with an area rug and cut a hole in the area rug for access to the target, ball-receiving cup.

In a simple form, the golf practice putting device consists of a simple receiving cup with a cylindrical side and a circular bottom attached to the underside of the planar cup suspension member below an opening in the cup suspension member. In a further refinement of the target, ball-receiving cup, an upper cylindrical sidewall is attached perpendicularly at its upper edge to an underside edge of an opening in the cup suspension member. A frusto-conical cup member or section is attached to the lower edge of the upper cylindrical sidewall. The wider portion of the frusto-conical cup member is attached to the upper cylindrical sidewall while the lower and narrower portion of the frusto-conical cup member is attached to a circular base at the outer edge of the base.

In yet a further refinement of the target, ball-receiving cup, a second or lower cylindrical sidewall of smaller diameter than the upper cylindrical sidewall is attached between the lower edge of the frusto-conical cup member and the circular base. Although the construction of the golf practice putting device has been described in terms of several distinct sections, it is to be understood that the entire device can be and preferably is molded from one piece of material.

The frusto-conical cup member or section and the lower cylindrical sidewall are provided in order to accommodate a ball retrieval means such as a ball retrieval basket. The ball retrieval basket consists of a frusto-conical basket member with outer dimensions conforming generally to the inner dimensions of the frusto-conical cup member so that the frusto-conical basket member mates with and is supported on the frusto-conical cup member. The circular basket bottom member is attached at its outer edge to the lower edge of the frusto-conical basket member to complete the ball retrieval basket. A flagpole is attached to the basket bottom member and is used in conjunction with the basket member to retrieve putted balls from the target, ball-receiving cup. Thus after several balls have been putted into the target, ball-receiving cup, they can be conveniently lifted from the receiving cup by lifting up on the flagpole and thereby retrieving the balls which are held in the ball retrieval basket. Other more complex ball retrieval means such as automatic ball returns can also be used with this invention.

The flagpole can be attached to the circular basket bottom member by any convenient means. Preferably a cuplike recess is formed in the basket bottom member and extends downward from the basket bottom into the cavity formed by the lower cylindrical sidewall of the target, ball-receiving cup. The cuplike recess is of such a size as to form a force fit with the flagpole bottom. For additional rigidity, the flagpole bottom may be glued or attached with other fasteners such as a screw or nail to more permanently secure it to the cuplike recess.

Generally the target, ball-receiving cup may be provided with apertures or openings to permit the flow of air into or out of the floor passage thereby enabling the floor passage to continue to serve as an air duct for hot or cold air. These apertures or openings should be of small enough sizes as to prevent the passage of a golf ball through them but of sufficient sizes as to allow a good circulation of air.

In a preferred embodiment of the invention, the frusto-conical member or section of the target, ball-receiving cup is provided with apertures or openings for the passage of air into or out of the floor passage. The frusto-conical basket member or section is also provided with similar apertures or openings that align or mate with the apertures or openings of the frusto-conical cup member. As a result, air circulation into or out of the air passage can be provided even when the ball retrieval basket is in place in the target, ball-receiving cup. In a preferred embodiment, the ball retrieval basket can be rotated in the target, ball-receiving cup so as to control the amount of alignment of the apertures in retrieval the basket with the apertures in the receiving cup thereby permitting the control of the amount of air flow into or out of the floor passage.

The foregoing and other advantages of the invention will become apparent from the following disclosure in which a preferred embodiment of the invention is described in detail and illustrated in the accompanying drawings. It is contemplated that variations in procedures, structural features and arrangement of parts may appear to the person skilled in the art without departing from the scope or sacrificing any of the advantages of the invention.

Figure 1:
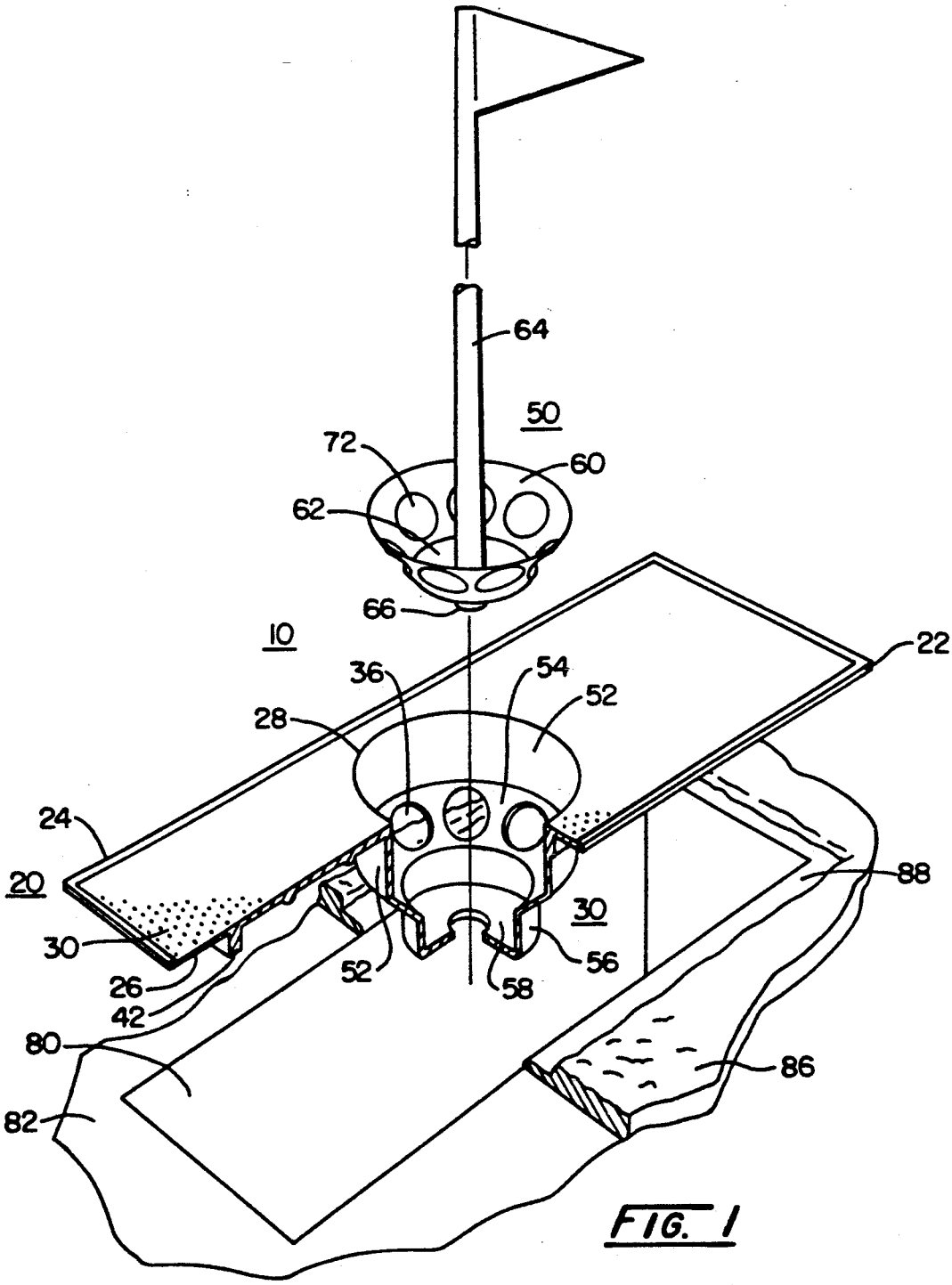
FIG. 1 is an exploded top, cut-away, perspective view of a golf practice putting device embodying the principles of the present invention showing the device for use with a floor passage in a carpeted floor.

In describing the preferred embodiments of the invention which are illustrated in the drawings, specific terminology will be restored to for the sake of clarity. However, it is not intended that the invention be limited to the specific terms so selected and it is to be understood that each specific term includes all technical equivalents which operate in similar manner to accomplish a similar purpose.

Although preferred embodiments of the invention have been herein described, it will be understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalence thereof.

DETAILED DESCRIPTION OF THE INVENTION AND BEST MODE FOR CARRYING OUT THE PREFERRED EMBODIMENT

A golf practice putting device 10 is shown in FIG. 1 and consists of a level covering means 20, a ball collecting means 30, and an optional ball retrieval means 50. In a simple form, the level covering means 20 can consist of a flat, planar cup suspension member 22 that extends beyond the edges of a floor passage 80 so as to cover the floor passage 80 and support the cup member 22 either directly or indirectly on the surrounding floor 82. The floor passage 80 is typically a hot or cold air duct. The flat, planar, cup-suspension member 22 has a topside 24, an underside 26, and an opening 28 therethrough.

In a preferred embodiment, the flat planar cup suspension member 22 is of such size as to conform, in size and thickness, to a depression 88 left in carpet 86 after removal of a covering grate or register (not shown). The thickness of the planar cup suspension member 22 is such that when placed in depression 88, the carpet 86 and the topside 24 of the suspension member 22 form a level surface. In a preferred embodiment, the thickness of suspension member 22 is less than the height of depression 88. In such an embodiment, a mat 30 of appropriate thickness is affixed to the topside 24 of suspension member 22 so as to produce a level surface with carpet 86. The mat 30 may be carpet, textured rubber or other resilient material. Preferably the texture and pattern of the mat 30 is such as to produce no noticeable change in the speed or direction of a golf ball as it passes from the carpet 86 to the mat 30.

Figure 3:
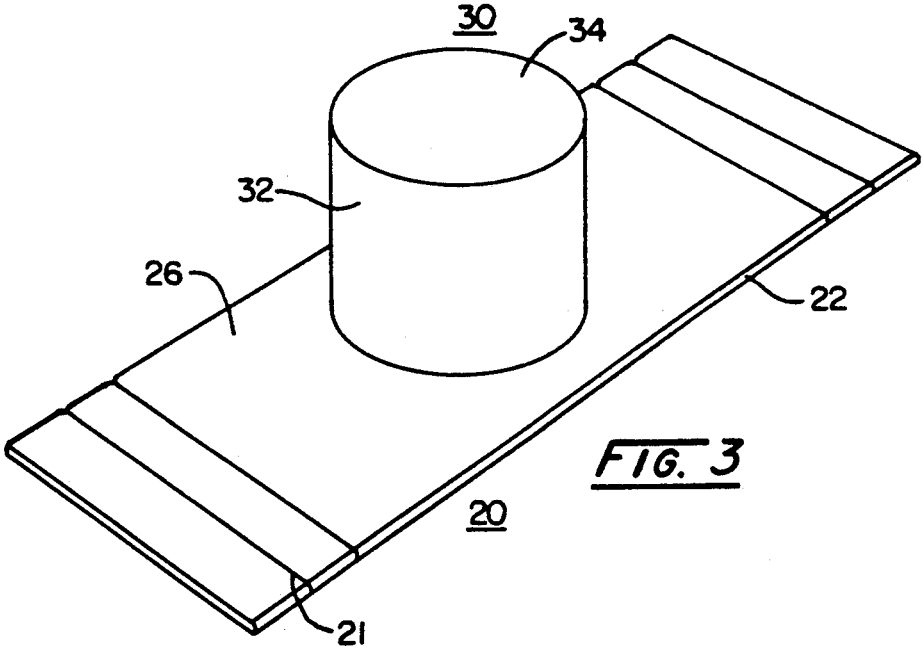
FIG. 3 is a bottom perspective view of an alternative embodiment of the invention.

As shown in FIG. 3, the cup suspension member 22 may be provided with indentations 21 on the underside 26 in order to facilitate the removal of excess portions of the cup suspension member 22. Recently, a standard has been developed for air duct sizes, typically one standard width and several standard lengths. By providing indentations 21, the cup suspension member 22 can be easily adapted to any of the standard sized ducts. Alternatively the cup suspension member 22 can be supplied in a larger size. The owner can then conform it to a custom duct by sawing or scribing and breaking off of the excess portions of material.

Figure 2:
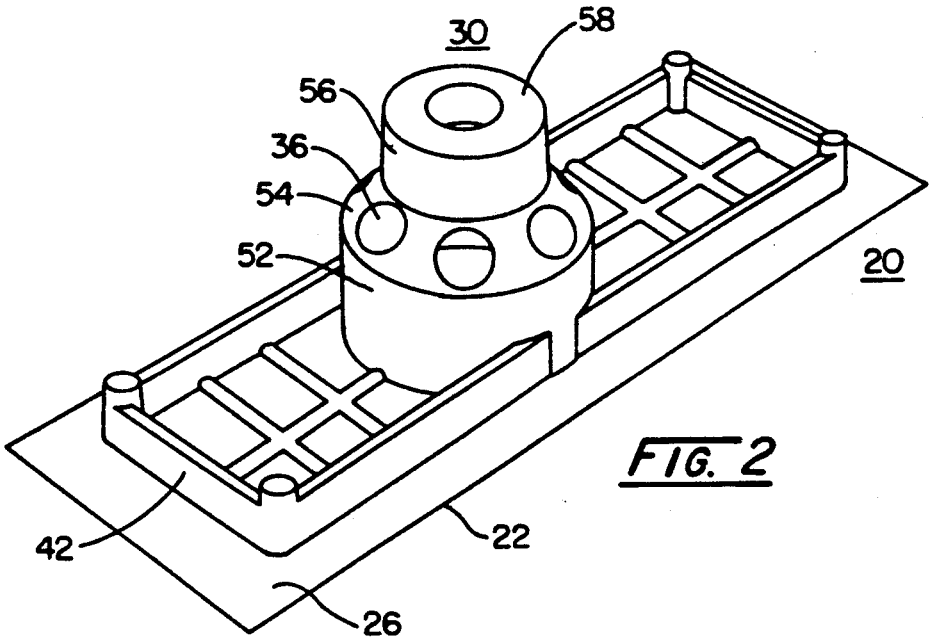
FIG. 2 is a bottom perspective view of the planar cup suspension member and attached ball receiving cup shown in FIG. 1.
Figure 4:
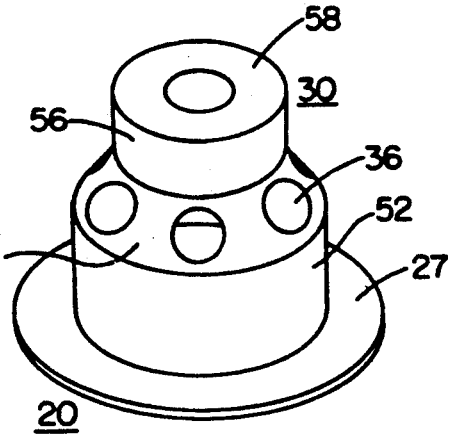
FIG. 4 is a bottom perspective view of a second alternative embodiment of the invention.

As shown in FIGS. 1, 2, and 4, apertures or openings 36 may be placed in the sides and bottom of the ball collecting means. Such apertures 36 are of such size as to prevent or block the passage of a golf ball therethrough but of sufficient size so as to allow the passage of air into or from the air duct 80.

As shown in FIGS. 1 and 2, the planar cup suspension member 22 may be provided with ribs 42 to strengthen and make more rigid cup suspension member 22. The ribs may be formed in any pattern or design so long as they project downward into the floor passage or air duct 80 and do not encroach into that outer area of the underside of cup suspension member 22 that makes direct or indirect contact with floor 82.

In a simple form shown in FIG. 3, the ball collecting means 30 consists of a cylindrical side 32 attached at one end to the underside edge of suspension member 22 that defines opening 28 and at the other end to the outer edge of circular bottom 34.

In a preferred embodiment of the invention shown in FIGS. 1,2, and 4, the ball collecting means 30 is of a more complex structure so as to provide for the incorporation of a ball retrieval means 50 into the ball collecting means 30 to be used for retrieving putted golf balls and for controlling the amount of air the passes out of or into the air duct or floor passage 80.

This more complex ball cup structure consists of an upper cylindrical side wall 52 attached perpendicularly at its upper edge to an edge surrounding the opening 28 in the cup suspension member 22. A frusto-conical cup member or section 54, narrowing from top to bottom, is attached at its wider edge to the lower edge of the upper cylindrical side wall 52. Although a circular base 58 may be attached at its outer edge to the lower or narrow edge of the frusto-conical cup member 54, it is preferable in one embodiment of this invention to attach a lower cylindrical side wall 56 between the lower edge of the frusto-conical cup member 54 and the circular base 58.

A ball retrieval means 50 designed for use with the complex ball cup structure described above consists of a frusto-conical basket member 60 whose outer dimensions conform generally to the inner dimensions of the frusto-conical cup member 54 so that the outer portion of basket member 60 mates with the inner portion of cup member 54 and is supported thereon. In a preferred embodiment to be described later, the retrieval basket 50 is capable of rotation within the receiving cup 30.

A basket bottom member 62 is attached at its outer edge to the lower edge of the frusto-conical basket member 60. A flag pole 64 is attached to the basket bottom member 62 by suitable means so as to form a ball retrieval basket that can be used to retrieve putted balls from the ball collecting means 30. Although the flag pole 64 can be attached to the basket bottom member 62 by means such as glue, nails, screws, and the like, it is preferable to form a cup-like member 66 in basket bottom member 62 that conforms in size to the exterior dimensions of the bottom section of the flag pole 64 so as to form a force fit between the inside of cup-like member 66 and the bottom section of the flag pole 64. When the ball retrieval means 30 is resting in the target, ball-receiving cup, the cup-like member 66 is contained in the interior space formed by lower cylindrical wall 56.

In a preferred embodiment of the invention illustrated in FIG. 1, the frusto-conical basket member 60 is provided with openings or apertures 72 for the passage of air that align with openings or apertures 36 in the frusto-conical cup member 54. By rotating the ball retrieval device 50 using the flag pole 64, it is possible to vary the alignment of the apertures 72 with apertures 36 so as to control the amount of air entering into or coming from duct 80. The size of apertures 72 and 36 should be small enough so as to prevent the passage of a golf ball but large enough to allow for the passage of air into or from the floor passage 80.

Although the various components of the ball retrieval means 50, the ball collecting means 30, and the level covering means 20 have been described as separate and distinct members, in many instances it is possible and preferred to form these units as a single piece. As shown in FIG. 1, all components of both the level covering means 20 and the ball collecting means 30 have been formed as a single unit.

Preferably the units of this invention are formed by injection molding of ABS (acrylonitrile-butadiene-styrene copolymer) plastic. Such a forming technique affords the maximum control in molding when top and bottom contours are a consideration. ABS plastic is preferred since it provides the greatest resistance to distortion.

Although this invention is designed primarily for use with hot and cold air floor ducts, FIG. 4 illustrates an alternative embodiment for custom applications. Thus a hole could be bored in a floor surface such as a deck floor large enough to accommodate side wall 52. A depression the thickness of flange 27 could be routed into the floor so as to accommodate flange 27 and provide a level floor/flange interface. Carpet could be laid over both the floor and flange 27 to form a deck practice putting device.

Although injection molding of ABS plastic is generally preferred, other manufacturing techniques may be employed and may offer specific advantages under certain conditions. For example, vacuum forming of ABS or polystyrene plastics may be used when cost is a factor. Reaction injection molding of structural foam may be used when the ability to vary wall thickness of the part to improve strength is a factor. Compression molding of thermoset plastics including fiberglass reinforced plastic and composites produces the most durable plastic part. Sheet metal stamping and spot welding can be used to provide the greatest durability in extreme temperatures and could be used in combination with wood for selected components. Cardboard-type materials could be used for a low cost version of the invention. Mesh or cloth materials can be used for the ball collecting means 30.

It may be possible that changes in configurations to other than those shown could be used but that which is shown is preferred and typical. Without departing from the spirit of this invention, various means of fastening the material together may be used.

It is therefore understood that although the present invention has been specifically disclosed with the preferred embodiment and examples, modifications to the design concerning sizing and shape may be apparent to those skilled in the art, and such modifications and variations are considered to be within the scope of the invention and the appended claims.

What is claimed is:

1. A golf practice putting device for use with a floor with a floor passage such as an air duct comprising:

a. a flat planar, cup-suspension member extending beyond and covering a floor passage and comprising a topside, an underside and having an opening passing therethrough that is capable of receiving putted golf balls and having indentations in said underside to facilitate the removal of excess portions of said planar, cup-suspension member; and b. a collecting means for collecting said putted golf balls passing through said opening where said collecting means is attached to an underside of said cup-suspension member and extends downward into a floor passage.

2. A golf practice putting device as set forth in claim 1 with said collecting means having at least one aperture of such size as to prevent the passage of a golf ball therethrough while allowing the passage of air into and from a floor passage.

3. A golf practice putting device as set forth in claim 1 with said planar, cup-suspension member having at least one rib on said underside to strengthen and make rigid said planar, cup-suspension member.

4. A golf practice putting device as set forth in claim 1 having a mat on said topside of said planar, cup-suspension member.

5. A golf practice putting device for use with a floor with a floor passage such as an air duct comprising:

a. a flat, planar, cup-suspension member covering and extending beyond the edges of a floor passage to form a level putting surface with a floor and comprising a topside, an underside, and an opening passing therethrough; and b. a target, ball-receiving cup recessed in said cup-suspension member and extending downward into a floor passage and comprising:

1) an upper cylindrical side wall attached perpendicularly at its upper edge to an edge surrounding said opening in said cup-suspension member;

2) a frusto-conical cup member attached at a wider upper edge to a lower edge of said upper cylindrical side wall;

3) a circular base attached at its outer edge to a narrower lower edge of said frusto-conical cup member by means of a lower cylindrical said wall attached at its upper edge to said lower edge of said frusto-conical cup member and at its lower edge to said outer edge of said circular base.

6. A golf practice putting device as set forth in claim 5 in which said frusto-conical cup member is provided with at least one aperture of such size as to prevent the passage of a golf ball therethrough while allowing for the passage of air into or out of a floor passage.

7. A golf practice putting device as set forth in claim 5 in which said circular base is provided with at least one aperture of such size as to prevent the passage of a golf ball therethrough while allowing for the passage of air into or out of a floor passage.

8. A golf practice putting device as set forth in claim 5 further comprising a ball-retrieval basket comprising:

a. a frusto-conical basket member whose outer dimensions conform generally to the inner dimensions of said frusto-conical cup member so as to mate therewith and be supported thereon;

b. a basket bottom member attached at its outer edge to a lower edge of said frusto-conical basket member;

c. a flag pole attached to said basket bottom member for lifting said ball-retrieval basket from said target, ball-receiving cup; and d. means for attaching said flag pole to said basket bottom member.

9. A golf practice putting device as set forth in claim 8 with said means for attaching said flag pole to said basket bottom member comprising a cup-like member extending downward from said basket bottom member and conforming in size to the exterior dimensions of a bottom section of said flag pole so as to form a force fit with said bottom section of said flag pole.

10. A golf practice putting device as set forth in claim 6 further comprising a ball-retrieval basket comprising:

a. a frusto-conical basket member whose outer dimensions conform generally to the inner dimensions of said frusto-conical cup member so as to mate therewith and be rotatably supported thereon and having at least one aperture aligning with said aperture of said frusto-conical cup member;

b. a basket bottom member attached to a lower edge of said frusto-conical basket member;

c. a flag pole rigidly attached to said basket bottom member for lifting said ball-retrieval basket from said target, ball-receiving cup and for rotating said ball-retrieval basket so as to control the amount of alignment of said aperture of said frusto-conical basket member with said aperture of said frusto-conical cup, member of said target, ball-receiving cup; and d. means for attaching said flag pole to said basket bottom member.

11. A golf practice putting device for use with a carpeted floor with a floor passage such as an air duct comprising:

a. a flat, planar, cup-suspension member having a topside, an underside, and an opening passing therethrough and extending beyond and covering a floor passage to form a level putting surface with a carpet when placed in a carpet depression adjacent to a floor passage; and b. a target, ball-receiving cup recessed in said cup-suspension member and extending downward into a floor passage and comprising:

1) an upper cylindrical side wall attached perpendicularly at its upper edge to an edge surrounding said opening in said cup-suspension member;

2) a frusto-conical cup member attached at its upper edge to a lower edge of said upper cylindrical side wall;

3) a lower cylindrical side wall attached at its upper edge to a lower edge of said frusto-conical member; and 4) a circular base attached to a lower edge of said lower cylindrical side wall.

12. A golf practice putting device as set forth in claim 11 further comprising a ball-retrieval basket comprising:

a. a frusto-conical basket member with outer dimensions conforming generally to the inner dimensions of said frusto-conical cup member so as to align therewith and be supported thereon;

b. a basket bottom member attached at its outer edge to a lower edge of said frusto-conical basket member;

c. a flag pole rigidly attached to said basket bottom member for lifting said basket member from said target, ball-receiving cup; and d. means for attaching said flag pole to said basket bottom member.

13. A golf practice putting device as set forth in claim 11 in which said frusto-conical cup member is provided with at least one aperture of such size as to prevent the passage of a golf ball therethrough while allowing the passage of air into and out of a floor passage.

14. A golf practice putting device as set forth in claim 13 further comprising a ball-retrieval basket comprising:

a. a frusto-conical basket member with outer dimensions conforming generally to the inner dimensions of said frusto-conical cup member of said target, ball-receiving cup so as to conform to and be rotatably supported on said frusto-conical aperture aligning with said aperture of said frusto-conical cup member of said target, ball receiving cup;

b. a basket bottom member attached at its outer edge to a lower edge of said frusto-conical basket member;

c. a flag pole rigidly attached to said basket bottom member for lifting said ball-retrieval basket from said target, ball-receiving cup and for rotating said ball-retrieval basket so as to control the amount of alignment of said aperture of said frusto-conical basket member with said aperture of said frusto-conical cup member of said target, ball-receiving cup; and d. means for attaching said flag pole to said basket bottom member.

15. A golf practice putting device as set forth in claim 14 with said means for attaching said flag pole to said basket bottom member comprising a cup-like recess extending downward from said basket bottom member and conforming in size to the exterior dimensions of a bottom section of said flag pole so as to form a force fit between said bottom section of said flag pole and said cup-like recess.

* * * * *